United States Patent [19]

Budzich

[11] 4,089,346

[45] * May 16, 1978

[54] LOAD RESPONSIVE FLUID CONTROL VALVES

[76] Inventor: Tadeusz Budzich, 80 Murwood Dr., Moreland Hills, Ohio 44022

[ * ] Notice: The portion of the term of this patent subsequent to Oct. 12, 1993, has been disclaimed.

[21] Appl. No.: 750,250

[22] Filed: Dec. 13, 1976

Related U.S. Application Data

[63] Continuation-in-part of Ser. No. 709,205, Jul. 27, 1976, Ser. No. 522,324, Nov. 8, 1974, Pat. No. 3,998,134, and Ser. No. 655,561, Feb. 5, 1976.

[51] Int. Cl.[2] ..... F15B 13/08

[52] U.S. Cl. ..... 137/596.13; 60/445; 91/421; 91/446; 137/596.1

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,807,447 | 4/1974 | Masuda | 137/596.13 |
| 3,882,896 | 5/1975 | Budzich | 137/596.1 |
| 3,984,979 | 10/1976 | Budzich | 60/445 |
| 4,020,867 | 5/1977 | Sumiyoshi | 137/596.13 |

*Primary Examiner*—Gerald A. Michalsky

[57] ABSTRACT

A load responsive direction and flow control valve for use in a fluid power load responsive system. The valve maintains a selected constant flow level for control of both positive and negative loads in parallel or series type circuits, irrespective of the change in the load magnitude or change in the fluid pressure, supplied to the valve. When controlling positive or negative loads the valve maintains a constant pressure differential across a flow control metering orifice utilizing a single load responsive controller, first by throttling fluid entering the inlet chamber and then by throttling the fluid leaving the outlet chamber. The load responsive controller blocks the pump flow to the motor while controlling negative load, providing the motor inlet with fluid from the motor exhaust.

14 Claims, 1 Drawing Figure

LOAD RESPONSIVE FLUID CONTROL VALVES

This is a continuation in part of applications Ser. No. 709,205 filed July 27, 1976 for "Load Responsive Valve Assemblies", Ser. No. 522,324 filed Nov. 8, 1974 now U.S. Pat. No. 3,998,134, for "Load Responsive Fluid Control Valves" and Ser. No. 655,561 filed Feb. 5, 1976 for "Load Responsive Fluid Control System".

BACKGROUND OF THE INVENTION

This invention relates generally to load responsive fluid control valves. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions in parallel or priority series type circuits.

In still more particular aspects this invention relates to direction and flow control valves capable of controlling simultaneously multiple positive and negative loads, which while controlling a negative load, interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Since in this system the variable control orifice is located between the pump and the load, the control signal to a pressure regulating throttling device is at a high pressure level inducing high forces in the control mechanism. Another disadvantage of such a control is that it regulates the flow of fluid into the motor and therefore does not compensate for fluid compressibility and leakage across both motor and valve. Still another disadvantage of such a control is that timing of the valve sequencing of operations must be very exact to prevent cavitation in the motor and to prevent the motor from being subjected to excessive pressures during control of negative loads. A fluid control valve for such a system is shown in U.S. Pat. No. 3,488,953 issued to Haussler.

Normally the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while these valves are effective in controlling positive loads they do not retain flow control characteristics when controlling negative loads, which instead of taking, supply the energy to the fluid system, and hence the speed of actuation of such a load in a negative load system will vary with the magnitude of the negative load. Especially with so-called overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they still utilize a controlling orifice located between the pump and the motor during positive load mode of operation and therefore control the fluid flow into the fluid motor instead of controlling fluid flow out of the fluid motor.

This drawback can be overcome by provision of load responsive fluid control valves as disclosed in my pending patent application Ser. No. 522,324 filed Nov. 8, 1974, entitled "Load Responsive Fluid Control Valves" now U.S. Pat. No. 3,998,134. However, while such valves maintain the pump discharge pressure higher, by a constant pressure differential, than the highest load pressure of system loads being controlled and are effective in controlling multiple positive loads, while maintaining a relatively constant down stream pressure at the motor exhaust, during control of negative loads these valves supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. Also these valves in their control system utilize pressure drop between load and outlet chamber therefore requiring a special set of load sensing ports.

This drawback can be overcome by provision of fluid control valves as disclosed in my U.S. Pat. No. 3,984,979. However, while those valves utilize actuator exhaust fluid for actuator flow requirement when controlling negative loads and are capable of working in parallel circuits they are not adaptable to series type circuits. In certain fluid power control systems it is desirable to provide a priority feature of series type circuit for a few selected loads, while controlling the majority of loads in a more universal and efficient parallel type circuit.

SUMMARY OF THE INVENTION

It is therefore a principal object of this invention to provide an improved load responsive fluid direction and flow control valve which blocks system pump from motor inlet and supplies it with system exhaust flow when controlling negative load and which is adaptable to both parallel and priority series type circuits.

Another object of this invention is to provide a load responsive fluid direction and flow control valve which is capable of retaining proportional control characteristics during control of positive and negative loads, while maintaining a low relatively constant pressure in front of a variable flow controlling orifice in parallel and series type circuits.

It is a further object of this invention to provide a load responsive fluid direction and flow control valve with positive and negative load controls, the positive load controls having a priority feature permitting control of down stream valves, while the valve with priority feature is not being used.

It is a further object of this invention to provide a load responsive fluid direction and flow control valve which includes a load check valve between its inlet and supply chambers, to prevent actuation of the load while the pump pressure is lower than the load pressure.

It is a further object of this invention to provide a load responsive fluid direction and flow control valve, equipped with load sensing control ports for sending load pressure signals to the system pump, with a device to unload pressure from these load sensing control ports while the load responsive valve is not being used in control of a load.

Briefly the foregoing and other additional objects and advantages of this invention are accomplished by providing a novel load responsive fluid direction and flow control valve for use during proportional simultaneous control of multiple positive and negative loads in parallel and priority series type circuits. A system pump is controlled in respect to pressure signal transmitted from system valves, corresponding to the highest system load pressure. The exhaust circuit of the system is pressurized, the exhaust flow being used to provide inlet flow requirements of motors controlling negative loads. Valves with a priority feature permit, while inactive, operation of the down stream valves. The valves both for parallel and series type operation are provided with load checks between their inlet and supply chambers, to prevent actuation of the load while the pump pressure is lower than the load pressure.

Additional objects of this invention will become apparent when referring to the preferred embodiments of the invention as shown in the accompanying drawing and described in the following detailed description.

DESCRIPTION OF THE PREFERRED EMBODIMENT

Figure 1:
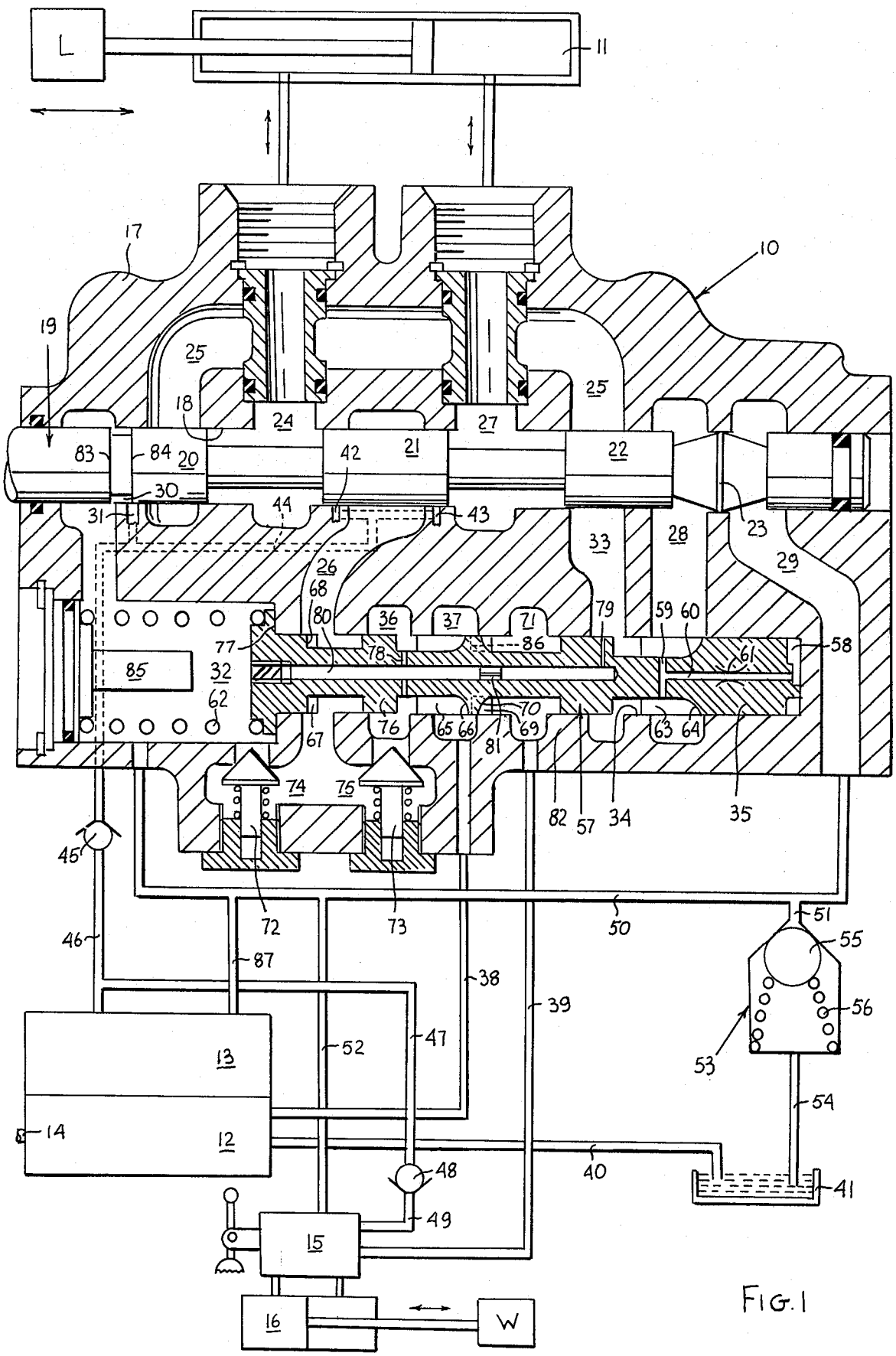
FIG. 1 is a longitudinal sectional view of an embodiment of a flow control valve having a positive and negative load control responsive to actuator down stream pressure with positive load control having a priority feature for use in load responsive fluid control system with pressure signal lines, common exhaust manifold with its exhaust relief valve, pump control, system pump, reservoir and other load responsive valve shown diagramatically.

Referring now to FIG. 1, an embodiment of a load responsive flow control valve, generally designated as 10, is shown interposed between a diagramatically shown first fluid motor 11 driving a load L and a pump 12, equipped with a load responsive flow control 13. The flow control 13 may be mounted directly on the pump 12 or can be made a part of the valve assembly. The pump 12 can be of a variable displacement type, in which case the flow control 13 is a differential pressure compensator, or of a fixed displacement type, in which case the flow control 13 is a differential pressure relief valve, both flow controls being well known in the art. The flow control 13, in a well known manner, automatically varies the flow delivered from the pump 12, to maintain a constant pressure differential between pump discharge pressure and maximum system load pressure being controlled. The pump 12 is driven through a shaft 14 by a suitable prime mover not shown. Another load responsive flow control valve 15, identical to the load responsive flow control valve 10, is interposed between the pump 12 and a second fluid motor 16 driving a second load W.

The load responsive flow control valve 10 is of a four-way type and has a housing 17 provided with a bore 18, axially guiding a valve spool 19. The valve spool 19 is equipped with isolating lands 20, 21 and 22 and a metering land 23. With the valve spool 19 in neutral position as shown in FIG. 1, land 20 isolates a load chamber 24 from an outlet chamber 25, land 21 isolates a supply chamber 26 from load chambers 24 and 27, land 22 isolates the outlet chamber 25 from the load chamber 27 and a first exhaust chamber 28 and metering land 23 isolates the first exhaust chamber 28 from a second exhaust chamber 29 while groove 30 connects port 31 with exhaust space 32. The outlet chamber 25 is cross-connected through passage 33 and bore 34, guiding a control spool 35, to the first exhaust chamber 28. The flow chamber 36 is cross-connected through bore 34 and the control spool 35 to an inlet chamber 37. The outlet of the pump 12 is connected through discharge line 38 to the inlet chamber 37. The outlet of the pump 12 is also connected through discharge line 38, bore 34 and line 39 to the load responsive flow control valve 15. The pump 12 is connected by suction line 40 with system reservoir 41. Pressure sensing ports 42 and 43, blocked in neutral position of the valve spool 19 by land 21, are connected through line 44, a check valve 45 and line 46 with the load responsive flow control 13, which can be an integral part of the pump 12 or can be a part of the flow control valve 10. Line 44 also connects pressure sensing ports 42 and 43 with port 31. Similarly the flow control 13 is connected through line 47, a check valve 48 and line 49 with the load sensing ports of the flow control valve 15. Exhaust lines 50, 51 and 52 form an exhaust manifold connecting the combined exhaust flow of flow control valves 10 and 15 with an exhaust relief valve, generally designated as 53, which is connected through line 54 with the system reservoir 41. The exhaust relief valve 53 is provided with a throttling member 55 biased by a spring 56.

A fluid throttling control, generally designated as 57, has the control spool 35 guided in bore 34. At one end (the right as viewed in FIG. 1), the control spool 35 is subjected to pressure existing in space 58 which is connected through passages 59 and 60 and flow restrictor 61 to the first exhaust chamber 28. The other end of the control spool 35, communicating with exhaust space 32, is subjected to pressure existing in space 32 and the biasing force of control spring 62. The control spool 35 is equipped with first throttling slots 63 terminating in throttling edges 64, communicating the outlet chamber 25 with the first exhaust chamber 28, second throttling slots 65 equipped with throttling edges 66, communicating the inlet chamber 37 with the flow chamber 36, slots 67 equipped with control surface 68 located between the supply chamber 26 and exhaust space 32 and bypass slots 69 and throttling edges 70 positioned between the inlet chamber 37 and a bypass chamber 71. Exhaust space 32 is connected with the supply chamber 26, for one way flow, by a suction check valve 72. The supply chamber 26 is also connected with the flow chamber 36, for one way flow, by a load check valve 73. The supply chamber 26 is provided with first extension 74 and second extension 75. The suction check valve 72 is interposed between first extension 74 and exhaust space 32. The load check valve 73 is interposed between second extension 75 and the flow chamber 36. The suction check valve 72 permits one way flow from exhaust space 32 to first extension 74 while the load check valve 73 permits one way flow from the flow chamber 36 to the second extension 75. Land 76 isolates the supply chamber 26 from the flow chamber 36. Increase in pressure differential between the first exhaust chamber 28 and exhaust space 32, acting on the cross-sectional area of the control spool 35, will first balance the preload of the control spring 62 and then move the control spool 35 from right to left.

The sequencing of the control spool 35 is such, that when moved from right to left, from position as shown in FIG. 1, it will first open communication through throttling edges 70 between the inlet chamber 37 and the bypass chamber 71, while full flow passage still exists through slots 65 between the inlet chamber 37 and the flow chamber 36 and through slots 63 between the first exhaust chamber 28 and the outlet chamber 25. Further movement of the control spool 35 from right to left will gradually enlarge flow passage between the bypass chamber 71 and the inlet chamber 37, while proportionally reducing flow passage between the inlet chamber 37 and the flow chamber 36, until throttling edges 66 will disrupt communication between the inlet chamber 37 and the flow chamber 36, with control surface 68 positioned in plane of flow surface 77, at the point of opening communication between the supply chamber 26 and exhaust space 32, while full flow communication still exists, through slots 63, between the outlet chamber 25 and the first exhaust chamber 28. Further movement of the control spool 35 from right to left will gradually close, with throttling edges 64, communication between the first exhaust chamber 28 and the outlet chamber 25, while full flow communication between exhaust space 32 and the supply chamber 26 is established and the inlet chamber 37 is still isolated from the flow chamber 36.

The control spool 35 is also equipped with passages 78 and 79 connected by passage 80 containing a restriction orifice 81. A web 82 separates the outlet chamber 25 from the bypass chamber 71. The passage 78 communicates with the inlet chamber 37 and passage 79 communicates with the outlet chamber 25, with control spool 35 in position as shown in FIG. 1. With control spool 35 in position as shown in FIG. 1 throttling edges 70 of bypass slots 69 isolate the bypass chamber 71 from the inlet chamber 37.

Preferably the size and position of lands of the valve spool 19 are such that movement of the valve spool 19 to the right, from the position as shown, will simultaneously cut off with timing edge of groove 30 communication between port 31 and exhaust space 32, connect the load chamber 24 with the pressure sensing port 42 and the load chamber 27 with the outlet chamber 25 and then connect the supply chamber 26 with load chamber 24, while metering land 23 still isolates the first exhaust chamber 28 from the second exhaust chamber 29. Further movement of the valve spool 10 to the right through displacement of metering land 23 will gradually open passage between the first exhaust chamber 28 and the second exhaust chamber 29, the area of fluid flow between these two chambers gradually increasing with displacement of valve spool 19. Movement of valve spool 19 to the left will first simultaneously connect the load chamber 27 with the pressure sensing port 43 and the load chamber 24 with the outlet chamber 25 and then connect the supply chamber 26 with the load chamber 27. Further movement of the valve spool 19 to the left through displacement of metering land 23 will gradually open passage between the first exhaust chamber 28 and the second exhaust chamber 29, the area of flow between these two chambers gradually increasing with displacement of valve spool 19.

Assume that the valve spool 19 is moved from left to right, from the position shown in FIG. 1. This will communicate the load chamber 24 with the pressure signal port 42 and the load chamber 27 with the outlet chamber 25, cut off with timing edge 83 of groove 30 communication between port 31 and exhaust space 32, while the metering land 23 still isolates the first exhaust chamber 28 from the second exhaust chamber 29. Assume also that the load chamber 24 is subjected to pressure of positive load. High pressure fluid will be transmitted through the pressure sensing port 42, line 44, and opening the check valve 45 will be further transmitted through line 46 to the flow control 13 of pump 12. This high pressure fluid conducted through line 47 will also close the check valve 48. In a well known manner the flow control 13 will vary flow from the pump 12, to maintain a pressure in discharge line 38, at a level higher by a constant pressure differential than the positive load pressure in the load chamber 24. Since the load chamber 24 is subjected to a positive load the load chamber 27, connected by displacement of the valve spool 19 to the outlet chamber 25, will be subjected to zero pressure.

Assume that the valve spool 19 is further moved from left to right connecting the supply chamber 26 with the load chamber 24, while metering land 23 still isolates the first exhaust chamber 28 from the second exhaust chamber 29. Increase in the pressure in the load chamber 24 will overcome the resistance of load L. Since the outlet of the fluid motor 11 is connected through load chamber 27 and the outlet chamber 25 to the first exhaust chamber 28 which is blocked by metering land 23, in a well known manner, pressure in the load chamber 27, the outlet chamber 25 and the first exhaust chamber 28 will begin to rise. This increased pressure in the first exhaust chamber 28 will equal the difference between the pressure in the load chamber 24 (which is connected to supply chamber 26) and the pressure necessary to support the load L. Increase in pressure in the first exhaust chamber 28, reacting on the cross-sectional area of the spool 35 will reach a force level which will overcome the preload in the control spring 62 and will move the control spool 35 to the left, closing the passage between the inlet chamber 37 and the flow chamber 36 and interrupting the supply of high pressure fluid to the supply chamber 26 and the load chamber 24. The response of the throttling control 57 can be influenced by selection of the size of the flow restriction 61. Smaller diameter of flow restriction 61 will slow down the response of throttling control 57 providing resistance to flow from the first exhaust chamber 28 to space 58. Subjected to the force of the pressure differential, existing between the first exhaust chamber 28 and exhaust space 32 and the biasing force of the control spring 62 the spool 35 of throttling control valve 57 will modulate to maintain a relatively constant pressure differential between first exhaust chamber 28 and exhaust space 32, by regulating the pressure level in the supply chamber 26 and load chamber 24. This relatively constant controlled pressure differential between first exhaust chamber 28 and exhaust space 32 will be approximately equal to the quotient of the preload in control spring 62 at the control position of spool 35 and the cross-sectional area of spool 35. Any rise in pressure in the first exhaust chamber 28, over that equivalent to the relatively constant controlled pressure differential level, will move the spool 32 to the left into a new modulating position, to relieve some of the pressure in the supply chamber 26, by cross-connecting it through bypass slots 67 with exhaust space 32, while maintaining passage between the inlet chamber 37 and the flow chamber 36 closed. Conversely, any decrease in the pressure in the first exhaust chamber 28 below that, equivalent to the relatively constant controlled pressure differential level, will move the spool 35 to the right, first closing communication between the supply chamber 26 and exhaust space 32 and then gradually connecting the supply chamber 26 through the load check valve 73 and the flow chamber 36 with high pressure fluid in the inlet chamber 37. Therefore the throttling control 57 will automatically regulate the pressure in the first exhaust chamber 28 to maintain a relatively constant controlled pressure differential between the first exhaust chamber 28 and exhaust space 32. With pressure in exhaust space 32 remaining constant the throttling control 57 will automatically maintain the pressure in the first exhaust chamber 28 at a constant level to retain a relatively constant pressure differential between the first exhaust chamber 28 and exhaust space 32, approximately equivalent to the quotient of the biasing force of the control spring 62 and the cross-sectional area of the spool 35.

Further movement of valve spool 19 to the right, through the displacement of metering land 23, will create an orifice between the first exhaust chamber 28 and the second exhaust chamber 29. Fluid flow will take place through the orifice between these chambers, momentarily lowering pressure in the first exhaust chamber 28. The spool 35 of throttling control 57 will change its modulating position, moving from left to right, creating an opening between the inlet chamber 37 and the flow chamber 36 through second throttling slots 65, throttling the fluid flow between those chambers to regulate pressure in the supply chamber 26, to maintain the pressure differential between the first exhaust chamber 28 and exhaust space 32 at a relatively constant level. Exhaust space 32 is connected through exhaust line 50 with the second exhaust chamber 29. Therefore a relatively constant pressure differential will also be maintained by the throttling control 57 between the first exhaust chamber 28 and the second exhaust chamber 29. Since the flow through the orifice at the metering land 23 is proportional to the orifice area, once a relatively constant pressure differential is maintained across the orifice, and since this pressure differential is automatically maintained relatively constant by the throttling control 57, the flow between the first exhaust chamber 28 and the second exhaust chamber 29 will also be relatively constant for any specific position of valve spool 19 and independent of the load pressure in the load chamber 24. Therefore each specific position of valve spool 19, corresponding to a specific orifice area between first exhaust chamber 28 and second exhaust chamber 29, will also correspond to a specific controlled flow level through the load responsive flow control valve 10. The fluid throttling control 57 maintains a relatively constant pressure differential between first exhaust chamber 28 and second exhaust chamber 29, the flow control therefore being independent of the pressure level in the second exhaust chamber 29. While throttling the fluid flow between the inlet chamber 37 and the flow chamber 36, to maintain a relatively constant pressure differential between first and second exhaust chambers, the spool 35 maintains full flow passage between the outlet chamber 25 and the first exhaust chamber 28, through first throttling slots 63. A sudden increase or decrease in load L, through corresponding momentary decrease or increase in pressure in the first exhaust chamber 28, will result in the change in throttling position of the spool 35. In each case with the condition of force equilibrium established, the pressure differential between first and second exhaust chambers will return to its relatively constant controlled level, with the control spool 35 modulating in each new position.

The exhaust fluid flow from the second exhaust chamber 29 is transmitted through exhaust line 51 to the low pressure exhaust relief valve 53, which permits the exhaust flow to reach the reservoir 41, while maintaining constant minimum pressure level in the second exhaust chamber 29, equivalent to the preload of the spring 56. Since the pressure in the exhaust space 32 is maintained at a constant level by the exhaust relief valve 53, the throttling control 57 throttles flow of fluid through flow control valve 10 to maintain pressure in the first exhaust chamber 28 at a constant level for any specific position of the valve spool 19.

Assume that the valve spool 19 is moved from left to right from its neutral position as shown in FIG. 1, connecting first the load chamber 27 with the outlet chamber 25, the load chamber 24 with the pessure sensing port 42 and cutting off with timing edge 83 of groove 30 communication between port 31 and exhaust space 32, while land 21 still isolates supply chamber 26 from load chamber 24 and metering land 23 isolates the first exhaust chamber 28 from the second exhaust chamber 29. Assume also that load chamber 27 is subjected to pressure of a negative load. Low pressure signal will be transmitted from pressure sensing port 42 to the flow control 13, in a well known manner, bringing the discharge pressure of the pump 12 to its minimum standby pressure level. Negative load pressure from the outlet chamber 25 will be transmitted through passage 33 and first throttling slots 63 to the first exhaust chamber 28 from where it will be transmitted to space 58 and will react on the cross-sectional area of the spool 35 moving it all the way from right to left, compressing the control spring 62 and engaging stop 85. In this position the control spool 35 will isolate the first exhaust chamber 28 from the outlet chamber 25, isolate the inlet chamber 37 from the flow chamber 36 and connect the supply chamber 26 with exhaust space 32. When, due to leakage across the metering land 23, which can normally be expected, the pressure in the first exhaust chamber 28 drops to a level, equivalent to the biasing force of the compressed control spring 62, the control spool 35 will move to the right and start to modulate, throttling the fluid flow from the outlet chamber 25 to maintain a relatively constant pressure in the first exhaust chamber 28, the passage between the inlet chamber 37 and the supply chamber 26 remaining blocked and the supply chamber 26 remaining open through slots 67 to exhaust space 32.

Further movement of the valve spool 19 to the right will first connect the supply chamber 26 with the load chamber 24, both of which are subjected to low pressure, and then through displacement of metering land 23 will open an orifice between the first exhaust chamber 28 and the second exhaust chamber 29. The resulting flow between these chambers will momentarily lower the pressure in the first exhaust chamber 28, causing an unbalance of forces acting on the spool 35. As a result the spool 35 will move from left to right throttling fluid flow from outlet chamber 25 to the first exhaust chamber 28, the outlet chamber being subjected to pressure of the negative load, to maintain a relatively constant pressure differential between the first exhaust chamber 28 and exhaust space 32 and therefore also a relatively constant pressure differential between first and second exhaust chambers, while the fluid flow through the orifice between these chambers takes place. The control spool 35 will modulate to maintain a relatively constant pressure differential between the first exhaust chamber 28 and the second exhaust chamber 29 in a position, at which first throttling slots 63 are partially closed and control spring 62 further compressed and exerting higher biasing force. The relatively constant controlled pressure differential between the first exhaust chamber 28 and exhaust space 32 is approximately equal to the quotient of biasing force of the control spring 62 and the cross-sectional area of control spool 35. Therefore, when controlling a negative load, control spool 35 will maintain a relatively constant control pressure differential at a higher level than the controlled pressure differential when controlling a positive type load. As previously described the position of the valve spool 19 and its metering land 23, which may be of a conical shape as shown or may be equipped with conventional metering slots, will determine the area of the orifice between the exhaust chambers and therefore the controlled flow level through the load responsive flow control valve 10 during control of negative load.

Since as previously described, the pressure in the second exhaust chamber 29 is maintained constant by the exhaust relief valve 53, when controlling a positive load the pressure in the first exhaust chamber 28 will be maintained at a first relatively constant pressure level and when controlling a negative load the pressure in the first exhaust chamber 28 will be maintained at a second relatively constant pressure level, the second relatively constant pressure level being higher than the first relatively constant pressure level due to greater force exerted by the compressed control spring 62.

The displacement of the fluid from the fluid motor 11 requires equivalent fluid flow into the fluid motor 11 to prevent cavitation. When controlling a negative load the control spool 35 isolates the inlet chamber 37 from the supply chamber 26 but connects the supply chamber 26 with exhaust space 32. The fluid motor exhaust fluid flows from second exhaust chamber 29 through exhaust lines 51 and 50 into exhaust space 32, from which it can follow two paths on its way to the load chamber 24 and fluid motor 11. The fluid can flow from exhaust space 32 through slots 67 to the supply chamber 26 and load chamber 24. The fluid can also flow from exhaust space 32 through suction check valve 72 to the supply chamber 26 and to the load chamber 24. If the fluid flow from the second exhaust chamber 29 is higher than the flow requirement of load chamber 24, part of this flow will be diverted through low pressure exhaust relief valve 53 and therefore fluid will be supplied to load chamber 24 at a pressure, equivalent to setting of low pressure exhaust relief valve 53.

If the valve spool 19 is moved from right to left, function of the load chambers 24 and 27 is reversed, for opposite direction of drive, but the valve functions in the same manner as described above.

The load responsive flow control valve 10 of FIG. 1 is capable of controlling both positive and negative loads, the flow through the valve being proportional to the position of the metering land 23 and therefore position of valve spool 19, irrespective of the magnitude of the controlled load both in positive and negative modes of load operation and in either direction of flow and therefore either direction of the movement of the fluid motor.

Since during control of negative load, in the flow control valve of FIG. 1, the outlet of the pump 12 is cut off from the supply chamber 26 and therefore from the inlet side of the motor 11 by the control spool 35 and since the inlet flow requirement of the fluid motor 11 is supplied from the exhaust manifold of the flow control valves 10 and 15, none of the pump flow is used during control of negative load. This feature not only greatly improves the efficiency of the system but also extends the pump capacity to perform useful work.

Assume that the valve spool 19 is moved very fast from left to right, connecting the load chamber 24 with the supply chamber 26, the load chamber 27 with the outlet chamber 25 and through the metering land 23 connecting the first exhaust chamber 28 with the second exhaust chamber 29. If the flow control 13 of the pump 12 would not respond fast enough to raise the pump discharge pressure to the required level, a back flow from the load chamber 24 to the pump 12 could take place, resulting in a small drop in load L. If at this time another flow control valve operates a lower load, the back flow could take place into the actuator controlling the lower load. This back flow is prevented by the load check valve 73, which closes communication between the supply chamber 26 and the flow chamber 36 thus closing communication between the fluid motor 11 and the pump 12 and other operating actuators, until the pump control responds, raising the pump discharge pressure to the required level, as dictated by the control pressure signal, transmitted from the pressure sensing port 42 or 43. Once the discharge pressure of the system pump 12 will become greater than the pressure in the load chamber 24 the load check valve 73 will open and the control will resume its normal mode of operation.

With system actuators not being operated by the load responsive valves flow control 13 maintains discharge line 38 at minimum standby pressure level. The pump discharge pressure from the inlet chamber 37 is transmitted through passage 78, restriction orifice 81, passages 80 and 79 to the outlet chamber 25 and the first exhaust chamber 28. With the valve spool 19 in its neutral position as shown in FIG. 1 the outlet chamber 25 and the first exhaust chamber 28 are isolated. The rising pressure in the first exhaust chamber 28, reacting on the cross-sectional area of control spool 35, will generate sufficient force to move the control spool 35 against biasing force of control spring 62 to a position, at which passage 79 becomes blocked by guiding surface of web 82. In this position the control spool 35 will interconnect the bypass chamber 71 with the inlet chamber 37, while communication between the inlet chamber 37 and the supply chamber 26 is still maintained. Therefore as long as the pump 12 is generating pressure it is directly connected through the inlet chamber 37, the bypass chamber 71 and line 39 with the inlet chamber of flow control valve 15.

Assume that during simultaneous control of positive loads L and W by flow control valves 10 and 15 with valve spools moved from left to right, load L becomes the higher of the two. Assume also that the combined flow demand of the flow control valves 10 and 15 will exceed the capacity of the pump 12. Pump pressure in discharge line 38 will start dropping below the level of the constant pressure differential maintained by the flow control 13 and therefore the difference between pressure due to load L and pressure in discharge line 38 will decrease. As a result the force equilibrium acting on the control spool 35 will be disturbed. The control spool 35, under action of force developed on its cross-sectional area by pressure in the first exhaust chamber 28, will move from left to right, moving throttling edges 66 out of their throttling position and throttling with throttling edges 70 fluid flow from the inlet chamber 37 to the bypass chamber 71. In this way flow control spool 35, by throttling action of the throttling edges 70, will maintain a constant pressure in the first exhaust chamber 28, this constant control pressure being maintained by regulating the bypass flow to the actuator 16. Due to this bypass throttling action the flow control valve 10 has a priority feature, which permits proportional control of laod L, when the combined flow demand of flow control valves 10 and 15 exceeds the flow capacity of the pump 12. If during simultaneous control of loads L and W, load W is the higher of the two and when flow demand of the flow control valves 10 and 15 exceeds the capacity of the pump 12, the system pressure will drop to a level, equivalent to load pressure L, at which time, in a manner as previously described, the control spool 35 will regulate, by throttling with the throttling edges 70, the bypass flow from the inlet chamber 37 to the bypass chamber 71, to maintain a constant pressure in the first exhaust chamber 28. Therefore, irrespective of the variation in the magnitude of the loads L and W, during simultaneous operation of flow control valves 10 and 15, once the combined flow demand of flow control valves exceeds the capacity of the pump 12, the flow control valve 10 always retains the priority feature. Since the pressure in exhaust space 32 is maintained at a constant level by the exhaust relief valve 53 the control valve 35 throttles flow of fluid through flow control valve 10 to maintain pressure in the first exhaust chamber 28 at a constant preselected level.

When controlling positive and negative loads the passage 79 is normally blocked by the guiding surface of the web 82 and therefore no flow takes place through the restriction orifice 81. Therefore the arrangement of passages 78, 79 and 80 with the restricting orifice 81 serves only one purpose and that is to connect the inlet chamber 37 with the bypass chamber 71, with the valve spool 19 of the flow control valve 10 in its neutral position. During normal operation of the control spool 35 when controlling positive or negative loads the flow transfer action of passages 78 and 79 stops. During the control of positive priority type load the small flow from passage 78 to passage 79 through restriction orifice 81 is insignificant, due to the fact that, the metering land 23 connects the first exhaust chamber 28 and the second exhaust chamber 29.

When elongating the bypass slots 69 by slots 86 shown in dotted lines, permanent communication is established between the bypass chamber 71 and the inlet chamber 37. With control spool 35 modified in this way the control of flow of control valve 10 is changed from series to parallel and the priority feature, as already described is lost.

As already described pump 12 can be of a variable displacement type, in which case flow control 13 is a differential pressure compensator or of a fixed displacement type in which case the flow control 13 is a differential pressure relief valve, both flow controls being well known in the art. Flow control 13 responds to pressure signal from the highest system load transmitted through the check valve logic system and is connected to the system exhaust (exhaust line 50) by low pressure line 87. If the pump 12 is of a variable displacement type low pressure line 87 provides exhaust passage for the flow control 13. If the pump 12 is of a fixed displacement type the flow control 13 will, in a well known manner, regulate the flow delivered to the system by bypassing the excess flow through the low pressure line 87.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having a fluid inlet chamber connected to a source of fluid pressure, a fluid supply chamber, first and second load chambers, a fluid outlet chamber, and fluid exhaust means connected to reservoir means, first valve means for selectively interconnecting said fluid load chambers with said fluid supply chamber and said fluid outlet chamber, said first valve means having a variable orifice means between said fluid outlet chamber and said fluid exhaust means, load check valve means interconnecting for one way fluid flow said fluid supply chamber with said fluid inlet chamber, and second valve means having positive load throttling means and isolating means between said fluid inlet chamber and said fluid supply chamber, and fluid replenishing means between said fluid supply chamber and said fluid exhaust means, said second valve means having means responsive to pressure differential acting across said variable orifice means and operable to maintain said pressure differential at a first relatively constant pressure level while fluid is being throttled by said positive load throttling means.

2. A valve assembly as set forth in claim 1 wherein said second valve means has negative load throttling means between said fluid outlet chamber and said fluid exhaust means, said means responsive to pressure differential acting across said variable orifice means operable to maintain said pressure differential at a second relatively constant pressure level while fluid is being throttled by said negative load throttling means.

3. A valve assembly as set forth in claim 1 wherein said housing has a fluid bypass chamber adjacent to said fluid inlet chamber, said second valve means having priority throttling means and bypass means operable to throttle or bypass fluid flow from said fluid inlet chamber to said fluid bypass chamber.

4. A valve assembly as set forth in claim 3 wherein said second valve means has bypass actuating means to open communication through said priority throttling and bypass means between said fluid inlet chamber and said fluid bypass chamber when said first valve means is in a neutral position and said variable orifice means remains closed.

5. A valve assembly as set forth in claim 4 wherein said bypass actuating means has positioning means of said second valve means to maintain full flow communication between said fluid inlet chamber and said fluid bypass chamber when said first valve means is in a neutral position and said variable orifice means remains closed.

6. A valve assembly as set forth in claim 1 wherein exhaust flow throttling means in said fluid exhaust means is interposed between said variable orifice means and said reservior means.

7. A valve assembly as set forth in claim 1 wherein said housing has a fluid flow chamber adjacent to said fluid supply chamber, said load check valve means interconnecting for one way fluid flow said fluid supply chamber and said fluid flow chamber.

8. A valve assembly as set forth in claim 1 wherein replenishing check valve means interconnect for one way fluid flow said fluid supply chamber and said fluid exhaust means.

9. A valve assembly as set forth in claim 1 wherein said means responsive to pressure differential acting across said variable orifice means has actuating means responsive to pressure upstream of said variable orifice means.

10. A valve assembly as set forth in claim 1 wherein said housing has a fluid exhaust chamber adjacent to said fluid outlet chamber, said variable orifice means being interposed between said fluid exhaust chamber and said fluid exhaust means.

11. A valve assembly as set forth in claim 1 wherein pressure signal port means selectively communicable with said first and second load chambers by said first valve means are operable to transmit a control pressure signal to said source of fluid pressure.

12. A valve assembly as set forth in claim 11 wherein pressure signal unloading means of pressure in said pressure signal port means is responsive to movement of said first valve means and operable to unload said signal pressure when said first valve means blocks said pressure signal port means.

13. A valve assembly as set forth in claim 1 wherein said housing has a fluid flow chamber adjacent to said fluid supply chamber and selectively communicable by said second valve means with said fluid inlet chamber, and a drain chamber adjacent to said fluid supply chamber and selectively communicable with said fluid supply chamber by said second valve means, said fluid supply chamber having a first and a second extension chamber, suction check valve means communicating for one way fluid flow said drain chamber and said first extension chamber and said load check valve means communicating for one way fluid flow said fluid flow chamber and said second extension chamber.

14. A valve assembly as set forth in claim 1 wherein said housing has a control chamber, fluid passage means to conduct fluid flow and pressure from upstream of said variable orifice means to said control chamber, flow restriction means in said fluid passage means, said second valve means being responsive to fluid pressure in said control chamber.

* * * * *